US005310180A

United States Patent [19]

Wu

[11] Patent Number: 5,310,180

[45] Date of Patent: May 10, 1994

[54] RACKET FRAME

[75] Inventor: Chao-I Wu, Taichung Hsien, Taiwan

[73] Assignee: Jan Sports Products Corp., Taichung Hsien, Taiwan

[21] Appl. No.: 24,777

[22] Filed: Mar. 2, 1993

[51] Int. Cl.[5] ..... A63B 51/00

[52] U.S. Cl. ..... 273/73 D

[58] Field of Search ..... 273/73 R, 73 C, 73 D, 273/73 L

[56] References Cited

U.S. PATENT DOCUMENTS

| | | | |
|---|---|---|---|
| 3,547,440 | 12/1970 | Deer | 273/73 D |
| 3,664,669 | 5/1972 | Lathan et al. | 273/73 D |
| 3,751,034 | 8/1973 | Partz et al. | 273/73 D |
| 3,815,660 | 6/1974 | Gallagher et al. | 273/73 D |
| 3,912,267 | 12/1975 | Lyon | 273/73 D |
| 4,185,822 | 1/1980 | Li | 273/73 C |
| 4,566,695 | 1/1986 | Melby | 273/73 D |

FOREIGN PATENT DOCUMENTS

| | | | |
|---|---|---|---|
| 2405941 | 8/1975 | Fed. Rep. of Germany | 273/73 D |
| 2263795 | 10/1975 | France | 273/73 D |

*Primary Examiner*—V. Millin
*Assistant Examiner*—Raleigh W. Chiu
*Attorney, Agent, or Firm*—Morton J. Rosenberg; David I. Klein

[57] ABSTRACT

A racket frame which includes an oval frame connected to a handle through a throat for hanging a network of catgut therein. The oval frame includes at least one groove around an endless inner wall thereof to hold at least one catcut mounting frame. Each catgut mounting frame has a plurality of catgut mounting tabs for mounting a catgut in setting up a network of catgut within the oval frame.

6 Claims, 4 Drawing Sheets

RACKET FRAME

BACKGROUND OF THE INVENTION

The present invention relates to racket frames and relates more particularly to a racket frame having catgut mounting tabs disposed around an endless inner wall thereof for inserting a catgut in setting up a striking surface within the oval frame.

The racket handle of a racket for tennis is generally comprised of an oval frame attached to a handle through a throat to hold a network of catgut for striking a tennis ball. FIG. 1 illustrates a catgut mounting structure for a racket according to the prior art. As illustrated in FIGS. 1 and 2, the oval frame (1) of the racket has a plurality of equally spaced through holes (13) through the inner wall (11) and the outer wall (12) thereof. An elongated binding strip (15) is mounted around the outer wall (12) of the oval frame (1), having a plurality of hollow pins (16) respectively fitted into the through holes (13) for inserting a catgut (14). Because through holes (13) should be made on the oval frame (1) for inserting the hollow pins (16) of the binding strip (15), the structural strength of the oval frame (1) will be weakened. Further, because the hollow pins (16) protrude beyond the inner wall (11) of the oval frame (1), they may be damaged by the catgut (14) or the catgut (14) may be damaged by the end of either hollow pin (16) while striking against the ball (see FIG. 3).

SUMMARY OF THE INVENTION

The present invention eliminates the aforesaid disadvantages. It is therefore an object of the present invention to provide a racket frame which protects the network of catgut on the inside of the racket head. It is another object of the present invention to provide a racket frame which eliminates the need of making wire holes on the racket head.

According to the present invention, a racket frame comprises at least one catgut mounting frame molded on an oval frame thereof on the inside. Each catgut mounting frame has catgut mounting tabs, which may be disposed for inserting the catgut either in the horizontal direction or the vertical direction, for fastening a catgut in setting up a striking surface within the oval frame.

DETAILED DESCRIPTION OF THE PREFERRED EMBODIMENT

Figure 1:
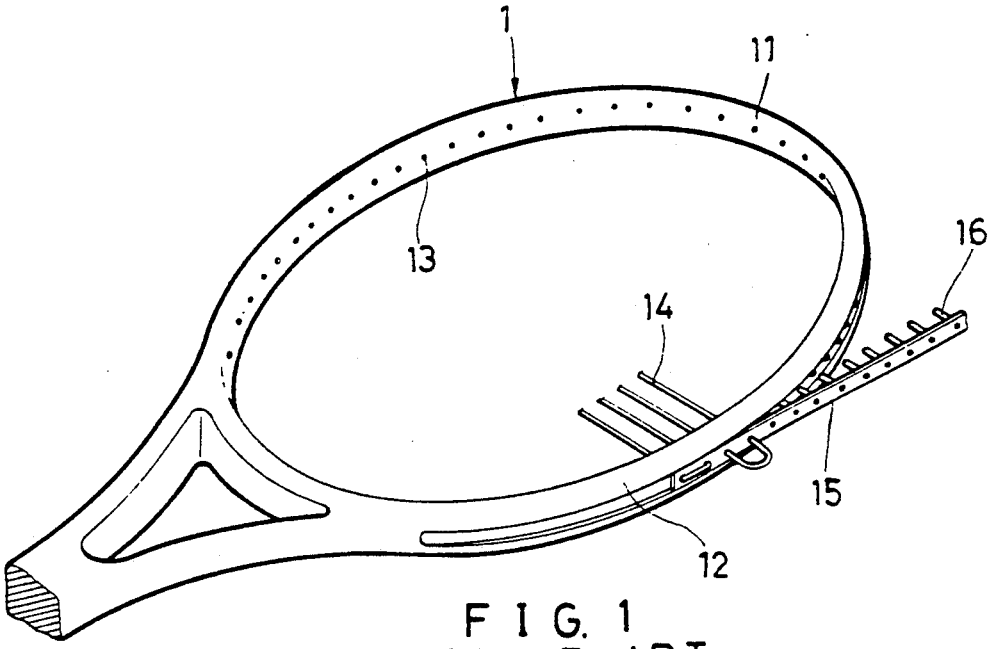
FIG. 1 PRIOR ART
FIG. 1 illustrates a catgut mounting structure for a racket according to the prior art.
Figure 2:
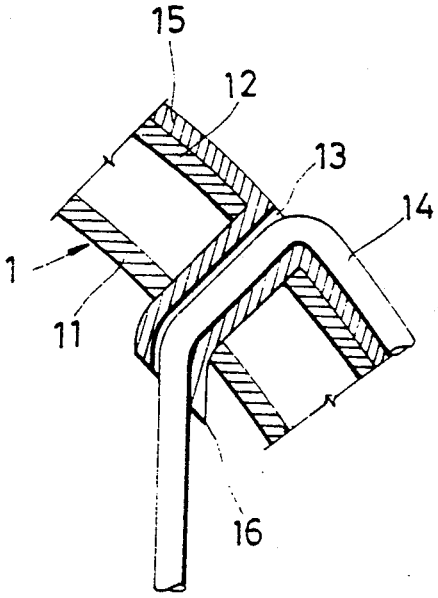
FIG. 2 PRIOR ART
FIG. 2 is a partial sectional view taken on FIG. 1, showing a catgut inserted through a hollow pin fitted into a wire hole on the head of the racket.
Figure 3:
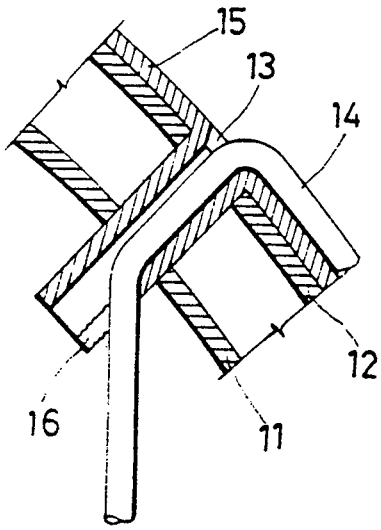
FIG. 3 PRIOR ART
FIG. 3 is similar to FIG. 2 but showing the end of the hollow pin damaged by the catgut.
Figure 4:
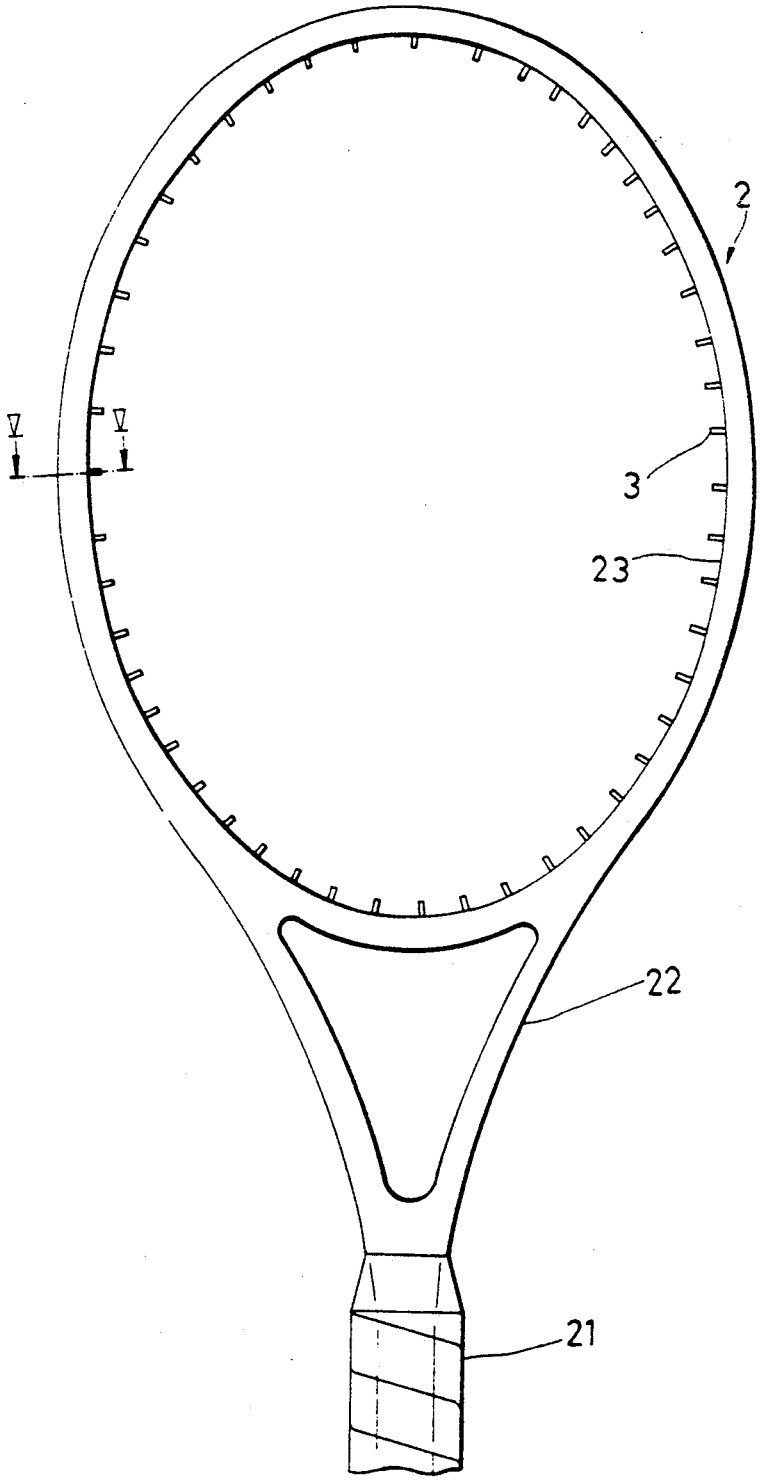
FIG. 4 is a front view of a racket frame constructed according to the present invention.
Figure 5:
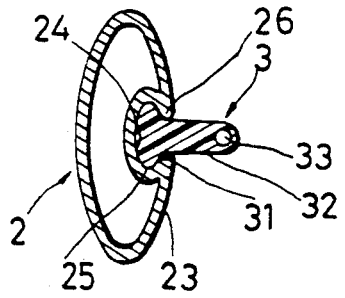
FIG. 5 is a cross section taken along line V—V of FIG. 4.
Figure 6:
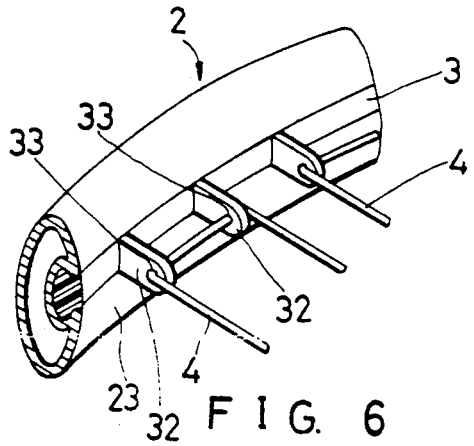
FIG. 6 is a partially cut away view of the racket frame shown in FIG. 4, showing a catgut mounting frame fastened to a groove on the oval frame of the racket frame.

Referring to FIGS. 4, 5 and 6, the racket head is defined by an oval frame 2 which is connected to a handle 21 through a throat 22 for hanging a network of catgut therein. The oval frame 2 has at least a groove 24 on an endless inner wall 23 thereof to hold a catgut mounting frame 3 each. In this embodiment, there is only an endless groove 24 around the endless inner wall 23 of the oval frame 2. The catgut mounting frame 3 comprises a mounting base 31 inserted in the endless groove 24 and retained in place by retaining flanges 26 on the peripheral wall 25 of the endless groove 24 at two opposite side edges thereof, and a row of equally spaced catgut mounting tabs 32 transversely projecting out of the endless groove 24. Each catgut mounting tab 32 has a hole 33 through which a catgut is inserted to set up a striking surface within the oval frame 2. The catgut mounting frame 3 is integrally molded from a suitable thermoplastic material. After the production of the catgut mounting frame 3, it is put in the mold for molding the oval frame 2. When molded, the catgut mounting frame 3 becomes firmly retained in the endless groove 24 by the retaining flanges 26.

Figure 7:
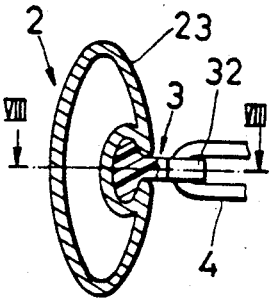
FIG. 7 is a cross section showing an alternate form of the catgut mounting tab according to the present invention.
Figure 8:
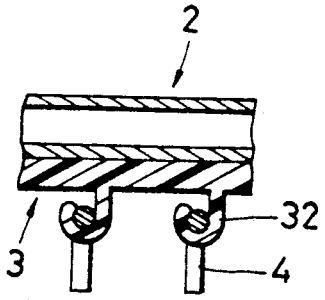
FIG. 8 is a cross section taken along line VIII—VIII of FIG. 7.
Figure 9:
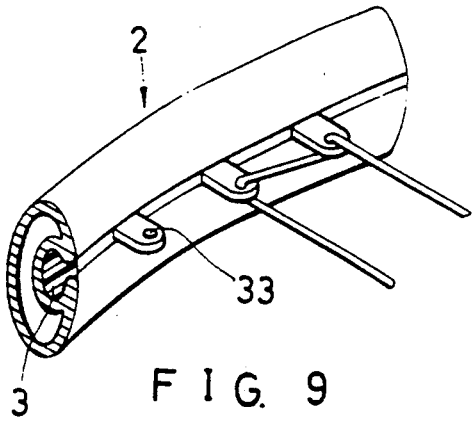
FIG. 9 is similar to FIG. 6 but showing the catgut mounting tabs disposed for inserting the catgut in the vertical direction.

Referring to FIGS. 7,8,9 and FIG. 6 again, the catgut mounting tab 32 may be variously embodied. In FIG. 6, the catgut mounting tab 32 has a wire hole 33 for threading the catgut transversely. In FIGS. 7 and 8, the catgut mounting tab 32 is made in the shape of a hook. In FIG. 9, the catgut mounting tab 32 has a wire hole 33 for threading the catgut in the vertical direction.

Figure 10:
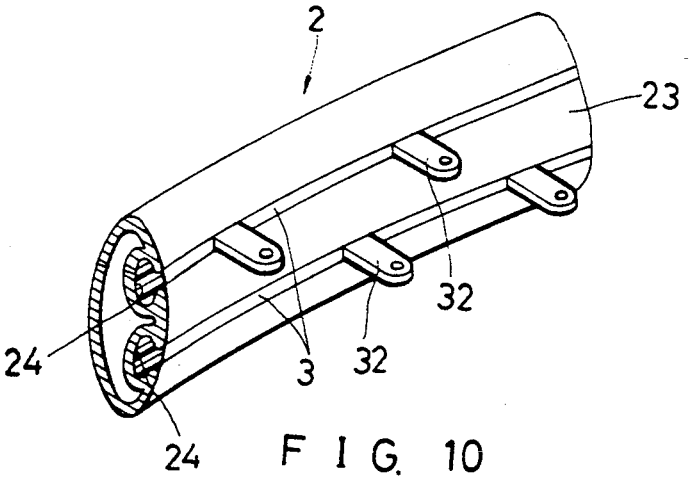
FIG. 10 is a partially cut away view of an alternate form of the oval frame showing catgut mounting tabs staggered at two different elevations.

Referring to FIG. 10, therein illustrated is an alternate form of the present invention. In this alternate form, there are two parallel grooves 24 on the endless inner wall 23 of the oval frame 2 to hold two catgut mounting frames 2 having catgut mounting tabs 32 staggered at different elevations.

Figure 11:
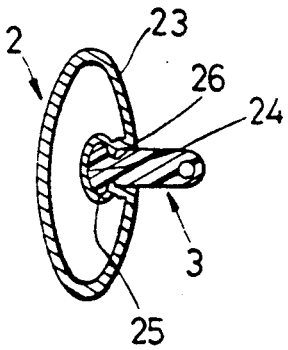
FIG. 11 is a cross section similar to FIG. 5 but showing a different arrangement of the retaining flanges on the respective groove.

Referring to FIG. 11, the retaining flange 26 may be formed on the peripheral wall 25 of the groove 24, in the middle of the side walls thereof.

While only a few embodiments of the present invention have been shown and described, it should be understood that various modifications and changes could be made without departing from the basic teachings and scope of the invention.

What is claimed is:

1. A racket frame having a head portion defined by an oval frame wherein said oval frame is coupled to a handle by a throat portion thereof, and oval frame comprising:

a closed contour frame member having at least one continuous recess formed in an inner surface thereof, said recess having a pair of retaining flanges formed on opposing side walls of said recess; and, means for mounting catgut fixedly coupled to said frame member, said mounting means including (1) a base member secured within said recess by said retaining flanges and extending around said closed contour, and (2) a plurality of spaced tab members extending radially from said base member, said plurality of tab members being formed integrally in one-piece formation with said base member, each of said tab members having a through opening formed therein extending transverse said radial direction of said tab member, whereby catgut is strung between adjacent pairs of said tab portions on opposing sides of said frame member to divide tensile forces therebetween.

2. The racket frame as recited in claim 1 where said mounting means is fixedly coupled to said frame member by a molding process, wherein said mounting means is disposed in a mold and said frame member is subsequently formed therein.

3. The racket frame as recited in claim 2 where said retaining flanges are formed on intermediate portions of said opposing side walls of said recess.

4. A racket frame having a head portion defined by an oval frame wherein said oval frame is coupled to a handle by a throat portion thereof, said oval frame comprising:

a closed contour frame member having a pair of spaced parallel and continuous recesses formed in an inner surface thereof, each of said recesses having a pair of retaining flanges formed on opposing side walls thereof; and a pair of mounting frames fixedly coupled to said frame member, each of said pair of mounting frames being disposed in a respective one of said pair of recesses and include (1) a base member secured within said respective recess by said retaining flanges and extending around said closed contour, and (2) a plurality of spaced tab members extending radially from said base member, said plurality of tab members being formed integrally in one-piece formation with said base member, each of said tab members having a through opening formed therein extending transverse said radial direction of said tab member, each of said tab members of one of said pair of mounting frames being in staggered spaced relation with respect to said tab members of the other of said pair of mounting frames.

5. The racket frame as recited in claim 4 wherein each of said mounting frames are fixedly coupled to said frame member by a molding process, wherein both of said mounting frames are disposed in a mold in spaced parallel relation and said frame member is subsequently formed therein.

6. The racket frame as recited in claim 5 where said retaining flanges are formed on intermediate portions of said opposing side walls of each of said pair of recesses.

* * * * *